United States Patent [19]

Knight

[11] Patent Number: 4,665,664

[45] Date of Patent: May 19, 1987

[54] DOME BUILDING STRUCTURE

[75] Inventor: Brian V. Knight, New Hartford, N.Y.

[73] Assignee: Orfus Limited of Grand Bahama Island, Freeport, The Bahamas

[21] Appl. No.: 609,331

[22] Filed: May 11, 1984

[30] Foreign Application Priority Data

Jan. 30, 1984 [WO] PCT Int'l Appl. ..... PCT/US84/00136

[51] Int. Cl.[4] ..... E04B 1/52

[52] U.S. Cl. ..... 52/81; 52/82

[58] Field of Search ..... 52/80, 81, 82, 86, 246, 52/245

[56] References Cited

U.S. PATENT DOCUMENTS

| | | | |
|---|---|---|---|
| 2,231,396 | 2/1941 | Smits | 52/81 |
| 2,705,349 | 4/1955 | Shaw | 52/81 |
| 3,513,608 | 5/1970 | Nagrad | 52/246 |
| 3,820,292 | 6/1974 | Fitzpatrick | 52/81 |
| 3,894,367 | 7/1975 | Yacoboni | 52/82 |
| 4,071,986 | 2/1978 | Wickwire | 52/81 |
| 4,180,950 | 1/1980 | Foster | 52/81 |
| 4,285,174 | 8/1981 | Knight | 52/82 |

FOREIGN PATENT DOCUMENTS

| | | | |
|---|---|---|---|
| 1000635 | 2/1952 | France | 52/80 |
| 1088479 | 10/1967 | United Kingdom | 52/81 |

*Primary Examiner*—Henry E. Raduazo

*Attorney, Agent, or Firm*—D. Peter Hochberg

[57] ABSTRACT

A domed building structure comprised of panels, convex from side to side, each panel including converging planar side members with straight outer edges, top and bottom planar plate members having curved outer edges, and a convex structural sheet attached to and conforming to the outer edges of the framework of side and plate members, the panels being arranged to form substantially conical frustums stacked one upon another with successively lower angles of inclination, the plate members bisecting the angles between the frustums.

11 Claims, 8 Drawing Figures

DOME BUILDING STRUCTURE

This invention relates to a dome shaped roof structure that may be erected upon a base or wall to become a building with a multitude of uses, for example, an agricultural building such as a barn, silo and the like, a storage building for granular material, bulk or prebagged, or a place of assembly such as an arena or restaurant.

Various building structures that diminish in size from bottom to top have been proposed. One of these is shown in Heiber Canadian Patent No. 744,895 issued Oct. 25, 1966 wherein a dome of generally spherical shape is constructed of relatively heavy rings stacked one upon another, the rings being formed of panels which are said to be planar. Another is shown in Fitzpatrick U.S. Pat. No. 3,820,392 issued June 28, 1974 wherein flat panels are assembled to provide a multifaceted building. Another is shown in Knight U.S. Pat. No. 4,285,174 issued Aug. 25, 1981 also using flat panels.

In the present invention a dome shaped roof structure is provided comprising a number of rings connected one upon another, each ring approximating a conical frustum. Each ring is made up of a plurality of panels that are an aliquot part of the ring. Each panel has opposed straight side members and outwardly convex top and bottom members. These side, top and bottom members are preferably made from lengths of lumber, which is planar, the edges of the top and bottom members being cut along elliptical curves to define the outward convexity. Each panel includes a structural sheet, i.e., a sheet capable of carrying a load, fixed to the side and top and bottom members of the panel. These sheets are preferably of plywood or fiberglass, cut to conform to the shape of the framework formed by the side, top and bottom members. Like panels are joined side to side to form the ring that approximates a frustum. The large diameter of an upper ring is similar to the small diameter of the next lower ring. By increasing the difference between the large and small diameters of each ascending ring, a dome-shaped structure is evolved by stacking one frustum upon another. The top and bottom members of the panels are used to connect the frustums together, and bisect the angles between the frustums. Because at least the outer edges of the top and bottom members of each panel define elliptical segments, and the outer structural sheets conform thereto, the frustums meet along elliptical segments which define scalloped lines around the dome.

The present invention provides a dome structure having the advantages of strength derived from the conical curvature of the structural sheets or skin. The structure can be assembled on the building site from factory prefabricated panels. The curved skin is entirely in compression when subjected to loads, such as wind loads, that are perpendicular to it.

Thus, according to the present invention, a dome building structure is erected using convex panels each of which has opposed, straight side members and outwardly convex top and bottom plate members, and to these members is attached a structural sheet. Like panels are joined side-to-side to create substantially conical frustums of panels. The top and bottom plate members are used in joining frustums of panels to each other. Frustums of panels are joined with decreasing diameters as the building height increases. The top plate member of a panel of a lower-disposed frustum is joined to a mating bottom plate member of a panel of an upper-disposed frustum. These plate members are planar members arranged at inclinations bisecting the angles between the frustums.

More generally, the invention provides a self supporting dome comprising a plurality of conical frustums stacked one upon another, the frustums comprising curved structural sheets, preferably plywood sheets. Successively higher frustums have lower angles of inclination. The tops of lower frustums conform to the bases of the next higher frustums so as to carry the weight of the higher frustums. The structural sheets can be sufficiently strong to carry the entire weight of the building. At their tops and bottoms they meet along elliptical lines.

This invention and the construction and disposition of its panels not only permit the building structure to be self supporting, providing a free-standing, clear-span building, but also permit the profile of the building structure to be variable so as to accommodate the stored material without wasted space or building materials.

Bulk materials such as salt, sand, potash, sulphate, etc. all have differing angles of repose when stored in a free pile. Therefore, to cover different materials efficiently without undue wasted space, a building structure permitting a choice of profiles is desirable. Since most materials soak up moisture from the air, the closer the building profile is to the particular material's angle of repose, the better. The variable profiles achieved in the inventive structure through the use of curved panels is of advantage. With the dome structure disclosed herein using panels that are convex from side to side, the building structure may closely approximate the profile of the stored material both in the horizontal and vertical planes. A further advantage is that conical frustums have great structural strength. External hips running down the dome are avoided, so that covering the resultant structure with shingles is facilitated. Curved panels when lying about or stacked prior to use do not end to buckle, and can shed water. When the panels are of plywood, the shedding of water helps prevent delamination.

The building structure can be made up of factory-manufactured, prefabricated building panels that can easily be transported to the building site and from one place to another. This permits the main construction work of the building to be performed indoors, at a manufacturing plant. Since the building components are such that standard trucks can readily transport them, no special hauling permits are necessary.

Details of preferred embodiments of the invention are descrioed in connection with the accompanying drawings, in which.

Figure 1:
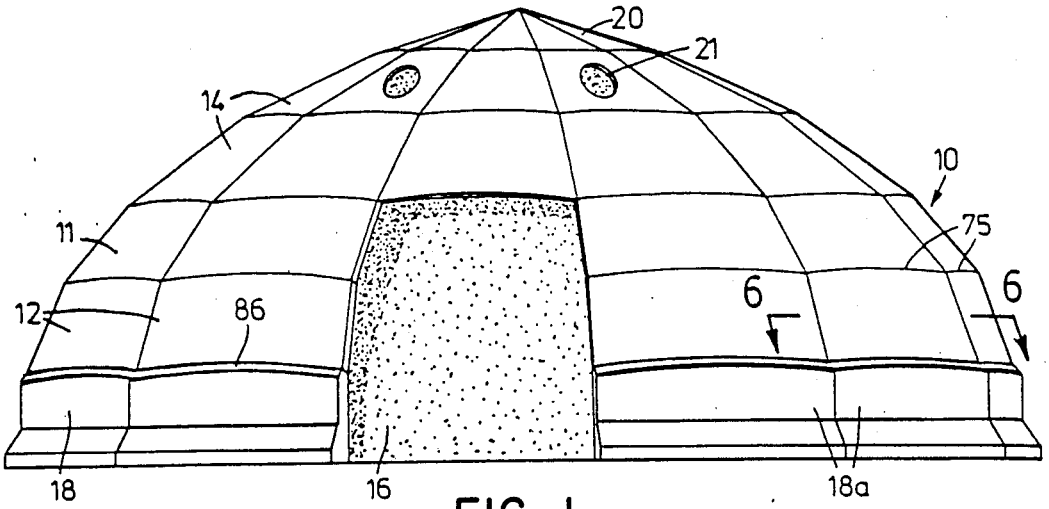
FIG. 1 is a side view of a building according to an embodiment of the invention.

A side view of an embodiment 10 of a building according to the invention is shown in FIG. 1. Building 10 consists of a number of panels 11 joined side by side to form substantially conical frustums of panels and joined top to bottom, i.e. frustum to frustum, to form a building that decreases in diameter with height, to form a dome. Each frustum consists of a group of preferably substantially identical panels 12 joined side by side. Preferably, the number of identical panels in a frustum is even. Panels 14 are joined top to bottom to form a wedge shaped sector of building 10. A full sector reaches from the bottom of building 10 to its top. Each successively higher panel in a sector is smaller in area than the one below, in keeping with the dome shape described by the building. Building 10 is shown without any covering, but may be painted or preferably covered with shingles or other protective covering.

Building 10 includes a doorway 16 created by omitting panels. The building is anchored to a base 18, preferably a reinforced concrete base. If formed of concrete the base 18 is preferably polygonal, having flat sides 18*a* defined by flat sided forms (not shown) into which the concrete was poured.

The top of building 10 is closed by a cap 20 which is attached to the uppermost conical frustum of panels. Ventilating openings 21 may be provided in the latter frustum.

Figure 2:
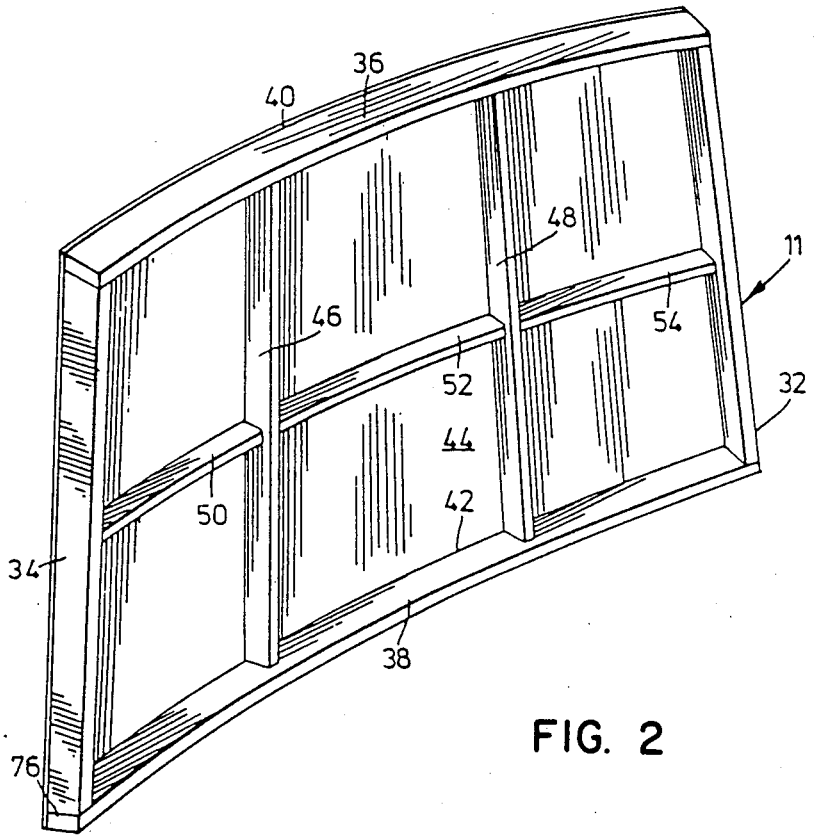
FIG. 2 is a perspective, interior view of a panel that can be used in the construction of an embodiment of the building.

The panels of the building 10 are outwardly convex from side to side in order to form the domed shape of the building. An interior view of a typical panel 11 is shown in FIG. 2. All elements of a panel are preferably wooden. The panels includes two opposed straight side members 32 and 34 that converge toward a top plate member 36 of the panel. Opposite top plate member 36 is a bottom plate member 38. Plate members 36 and 38 each have on their edges toward the building exterior a curved surface 40 and 42, respectively. Side members 32 and 34 and plate members 36 and 38 are joined at their corners to form a framework. As is hereinafter explained, the plate members in an assembled building form oblique angles with the horizontal and therefore the ends of side members 32 and 34 are cut at angles to permit a tight fit to the plate members. A structural sheet 44, which is preferably of plywood or fiberglass, is fit over the outside edges of the framework and attached to it, for instance by nailing and gluing. A plywood sheet may be thin, such as ½ inch thickness to reduce costs and building weight, depending upon the size of the building and the static (e.g. building weight) and dynamic (e.g. wind forces) loads it must carry. Because of the curved surfaces on the plate members, the sheet 44 is convex from side to side of each panel. A panel preferably includes braces 46 and 48 between the plate members and bridging 50, 52 and 54 between the braces. Bridging 50, 52 and 54 includes curved edges to fit tightly against the sheet 44. The amount of bracing and bridging will depend upon the area of the panel.

Panels like that shown in FIG. 2 can be joined to one another by conventional means, for example by nuts, washers and bolts extending through coaxial holes drilled in the side and plate members of adjacent panels. Like panels are joined side-to-side and thereby substantially describe the surface of a conical frustum. Frustums of decreasing diameter are joined as the building increases in height. The frustums are not necessarily independently built as the building is erected. The plate members 36 of adjacent panels of a single frustum define a continuous plate along the top of the frustum, and the plate members 38 form a continuous plate along the bottom of the frustum. Adjacent frustums are joined along their mutual top and bottom plates. The top plate member of a lower panel is of nearly the same dimensions as the bottom plate member of the next higher panel to produce a neat fit and a weather tight building.

Particular advantages are achieved in the structure disclosed herein because of its variable profile and convex shape. The term profile refers to the line described by the exterior of the building when sectioned by a vertical plane intersecting the vertical center axis of the building. A portion of such a profile is shown along the left hand edge of FIG. 3. There, a lowermost panel A has a side member 62 and a top plate member 64 joined to a bottom plate member 66 of the next higher panel B. Panel B has a side member 68 and a top plate member 70 joined to a bottom plate member 72 of a panel C that has a side member 74. The side members 62, 68, 74 are aligned to define an edge of a wedge shaped sector of the building. The interface plane between the panels A and B is indicated as $I_1$ and between panels B and C the interface plane is indicated by $I_2$. Horizontal reference lines $H_1$ and $H_2$ are drawn to intersect the profile of the building and each interface plane $I_1$ and $I_2$. Panel A forms an angle $\theta_1$ with the horizontal, while panel B forms an angle $\theta_2$ with the horizontal. It is a simple matter to choose these angles so that the profile of the building closely follows the angle of repose of the material to be stored within the building, while being clear of the stored material. The design selection of these angles is arbitrary and is realized in practice by properly curving the outer edges of the plate members of a panel and angling the ends of the panel side members. It is noted that the plane $I_1$ bisects the angle between panels A and B. One half this angle is indicated by $\theta$ and is equal to ninety degrees minus one half the difference between the inclination of the panels, i.e. $90° - \frac{1}{2}(\theta_1 - \theta_2)$.

Because the interface planes $I_1$ and $I_2$ intersect conical surfaces at an angle thereto, the meeting lines between these conical surfaces are segments of ellipses. In consequence, the conical frustums do not meet along horizontal planes, but rather along scalloped edges indicated (with some exaggeration) at 75 in FIG. 1. The curved outer edges of the top and bottom plate members are elliptical surfaces. The dimensions of one of these curved surfaces can be approximately calculated as shown in FIG. 4.

Figure 3:
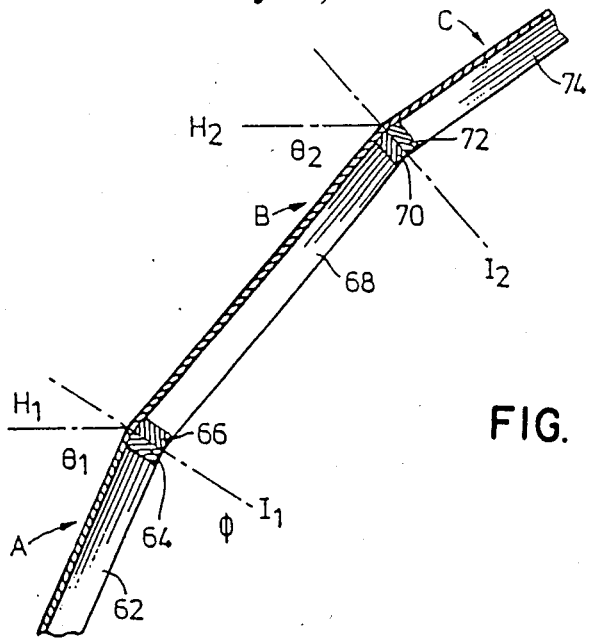
FIG. 3 is a fragmentary sectional view of panels used in an embodiment of the building.
Figure 4:
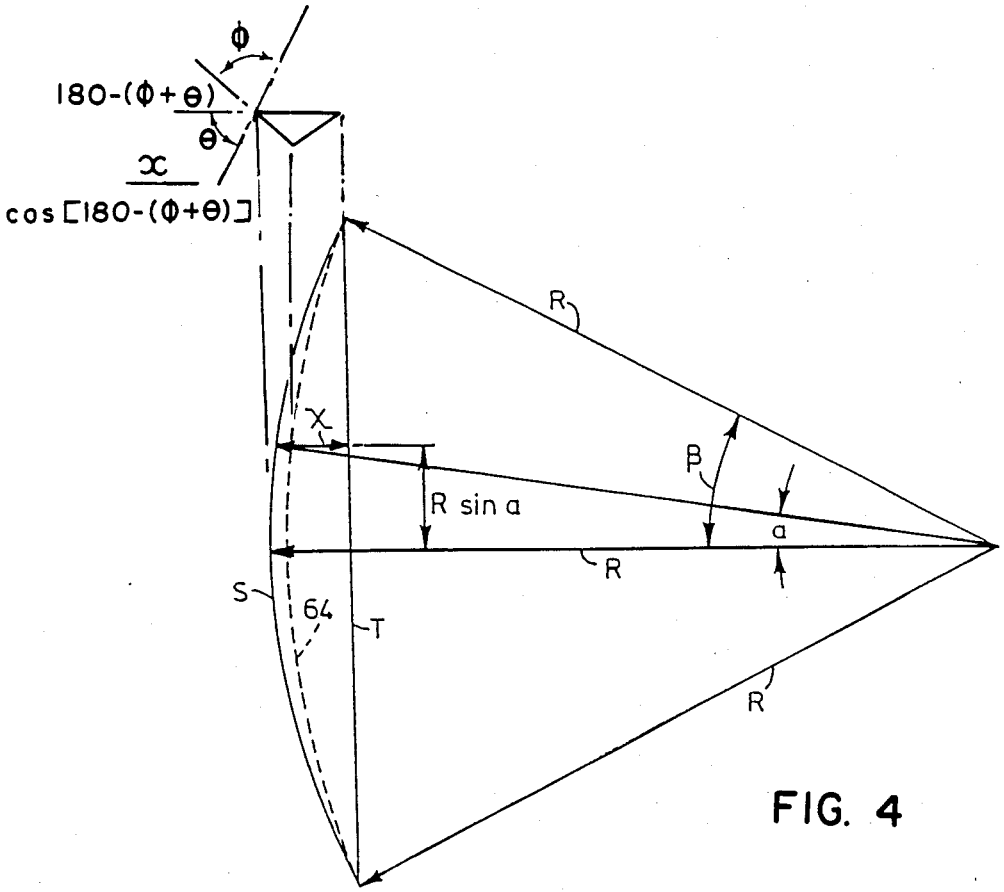
FIG. 4 is a diagram explanatory of calculations for the curvature of the outer edge of a top or bottom panel member.

Referring to FIG. 4, assume that a chord T is drawn between the top outer corners of a plate member such as 64 in FIG. 3. Horizontal radii R are drawn between the ends of the chord and the vertical axis of the building. These are radii of a circle S also having the chord T. The chord subtends an angle equal to 360° divided by the number of wedge shaped sectors of the building, and half that angle is defined as $\beta$. Let $\chi$ be the distance between a point on the circle S and the chord. The distance $\chi$ is a maximum at the radius which bisects the chord; there its value equals $(R - R \cos \beta)$.

At any angle $\alpha$ measured from the bisecting value, $\chi$ is equal to its maximum value less an amount equal to (R−R cos $\alpha$). Thus, at any angle $\alpha$, $\chi$=(R−R cos $\beta$)−(R−R cos $\alpha$)=R(cos $\alpha$−cos $\beta$). But the inclination of the plate member requires a projection of this $\chi$ on an oblique plane that depends on the position of the plate member within the building. The projection is made by dividing $\chi$ by cos [180−($\phi$+$\theta$)] so that the distance of the edge of plate member 64 from the chord is $$\frac{R(\cos\alpha + \cos\beta)}{\cos[180 - (\phi + \theta)]}$$

at a distance R sin $\alpha$ from the bisecting sin $\phi$ radius, where

R=horizontal radius of the building at the chord;

$\theta$=angle of the panel A with respect to the horizontal;

$\phi$=half the angle between the adjacent panels;

$\alpha$=angle from the bisecting radius of the chord, and $\beta$=one half the angle subtended by the chord.

Figure 5:
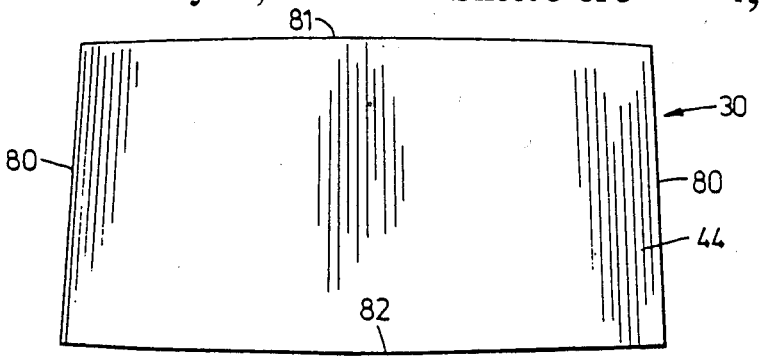
FIG. 5 is a view normal to the surface of the structural sheet of the panel of FIG. 2.

As shown in FIG. 5, if a panel, such as panel A of FIG. 3 or panel 11 of FIG. 2, is viewed face on, its sheet 44 will have straight side edges 80 that converge upwardly, a top, upwardly convex edge 81, and a bottom, downwardly convex edge 82, the curvatures being exaggerated in FIG. 5.

Figure 6:
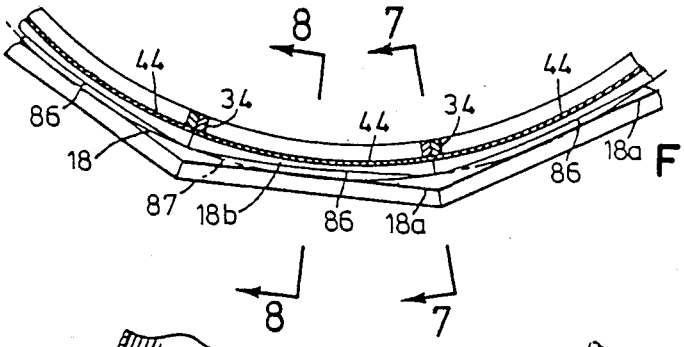
FIG. 6 is a fragmentary sectional view taken along the line 6—6 in FIG. 1 but, for clarity, eliminating braces visible in FIG. 2.
Figure 7:
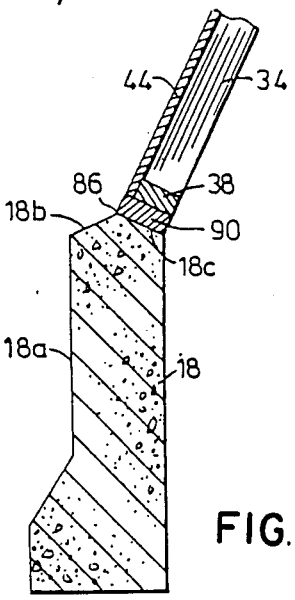
FIG. 7 is a fragmentary sectional view taken along the line 7—7 in FIG. 6.

A preferred mode of securing the panels to a concrete base is shown in FIG. 7. The base 18 is of reinforced concrete with an outwardly sloped top surface 18*b*. Inwardly of the surface 18*b* is another surface 18*c* inclined at the angle of the bottom plate members 38 of the lowermost conical frustum. An intermediate wooden plate 90 is preferably affixed to the base along the surface 18*c*. Because of the inclination of these plate members relative to the conical surfaces of the panels, the outer edges 86 where the conical frustum meets the base 18 are not perfectly circular but are slightly scalloped as indicated in FIG. 6 where, for reference purposes, a perfect circle 87 has been indicated by a broken line.

Figure 8:
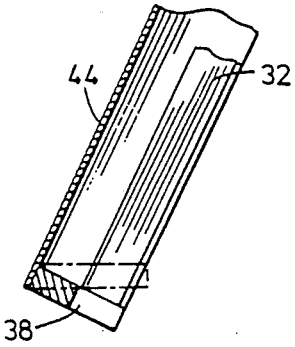
FIG. 8 is a fragmentary and slightly enlarged sectional view taken along the line 8—8 in FIG. 6 but showing only parts of a panel.

In FIG. 2 the plate members 36, 38 are shown as having curved inner surfaces as well as curved outer surfaces. This facilitates stacking of panels when they are transported to the building site. The panels will of course be stacked with their curved sheets 44 uppermost, to shed water. It is advisable that the end 76 of a plate member such as 38 be of sufficient width to be firmly attachable to a side member such as 34. Referring to FIG. 8, if a plate member 38 were arranged horizontally as shown in broken lines, it would have to be cut from substantially wider material to abut the end of a side member 32. Having the plate members at an incline as illustrated facilitates using lumber of standard sizes to form the plate members. As already mentioned with reference to FIG. 3 the plate members are inclined at angles which bisect the angles between adjacent frustums.

The panels are preferably of a size that can economically use standard plywood sheets with as little waste as possible. The sheets are bent to the necessary curvature and affixed to the side and plate members and to any bridging and bracing members of the panels. These structural sheets, defining substantially conical frustums, form a stressed skin which can have sufficient strength to support the entire structure and any snow or wind loads to which the structure is likely to be subjected, so that the other members, such as 32, 34, 36 and 38, provide means for assembling the building, although they will of course provide supplemental structural strength. The structural sheets 44 are in compression from the weight of the dome. When the sheets 44 are of plywood, all plies are in compression and the sheets are not in "rolling" shear caused by tension in one or more plies and compression in one or more others. Knowing the loads that must be withstood at any location, such as snow and wind loads, and any mechanical load such as a conveyor to fill the building from the top, one can determine the thickness of the sheets necessary to sustain the compressive forces. The curved structural sheets 44 are able to carry significantly greater loads than corresponding flat sheets. The peripheral supports 18 at the base of the building are in tension and it is therefore important to provide a concrete base with reinforcing steel, as is customary.

A building constructed in accordance with the invention consists ideally of perfectly conical frustums stacked one upon another, but it may of course be difficult to construct perfectly conical frustums meeting along edges 75 that consist of perfectly elliptical scallops, and therefore structures that in substance have these shapes are intended to be covered by the following claims. The term frustum will of course include a frustum that is interrupted by a doorway or other opening such as the doorway 16, or a doorway having vertical sides cut through one or more panels as shown, for example, in the abovementioned U.S. Pat. No. 4,285,724, FIGS. 1 and 2. Where a frustum is interrupted by a doorway it may be desirable to run a reinforcing wire around the building above the doorway and passing through the side members 32, 34 of the panels and tightened by turnbuckles.

The invention has been described with reference to preferred embodiments, but those skilled in the art will recognized various modifications and additions without departing from the spirit of the invention.

I claim:

1. A self-supporting dome comprising a plurality of substantially conical frustums stacked one upon another, the tops of lower frustums conforming to the bases of the next higher frustums so as to carry the weight of the higher frustums, successively higher frustums having lower angles of inclination, said frustums having:

curved structural sheets having top portions and bottom portions;

top plates extending along the top portions of said sheets; and, bottom plates extending along the bottom portions of said sheets; the top plate of one sheet being secured to the bottom plate of the adjacent sheet of an adjacent higher frustum, said plates having curved outer edges to which said curved structural sheets are fixed, and being inclined to bisect the angle formed between the adjacent frustums.

2. A dome as claimed in claim 1 wherein the top and bottom plates comprise elongated plate members and the frustums comprises a plurality of panels each of which is an aliquot of its respective frustum and each of which comprises:

a top and bottom planar plate member, a pair of upwardly converging planar side members, and one of the structural sheets being affixed to the outside of said plate and side members, the side members of adjacent panels of each frustum being secured together.

3. A dome as claimed in claim 2 wherein the side members of panels of different frustums are aligned.

4. A dome as claimed in claim 3 wherein the panels of adjacent frustums meet along elliptical segments which define scalloped lines around the dome.

5. A dome as claimed in claim 4 wherein the panels are prefabricated wooden panels.

6. A dome as claimed in claim 4 wherein the structural sheets are fiberglass sheets.

7. A dome comprising a plurality of convex panels, each panel having opposed, upwardly converging planar side members having substantially straight outer edges, opposed top and bottom planar plate members each having outer edges curved to define the convexity of the panels, and outwardly curved structural sheets separate from said plate members, said sheets being fixed to and conforming to the outer edges of said side and plate members wherein substantially similar panels are mutually joined along their side members to describe a substantially conical frustum formed by said sheets and a plurality of said frustums are mutually joined along respective top and bottom plate members of the panels to form a dome having a horizontal cross sectional area decreasing with the height of the dome, each of said frustums being inclined with respect to the horizontal to form an angle of inclination and wherein each higher frustum has a smaller angle of inclination than each lower frustum.

8. The dome of claim 7 wherein the angles of inclination of the frustums approximate the angle of repose of a material to be stored within said building.

9. The dome of claim 7 wherein the planar plate members bisect the angles between the frustums and the frustums meet along elliptical segments which define scalloped lines around the dome.

10. A self supporting dome comprising a plurality of rings each approximating a conical frustum with the bottom of one frustum resting on the top of another, successively higher frustums having successively lower inclinations, each frustum comprising a plurality of panels, each panel comprising side members by which the panels are secured together, top and bottom members by which the rings are secured together, and a structural sheet affixed to the outsides of said side, top and bottom members, the side, top and bottom members being planar members, the outsides of the side members being straight and the outsides of the top and bottom members being convex non-circular elliptical segments.

11. A dome as claimed in claim 10 wherein the top and bottom members bisect the angles between adjacent frustums.

* * * * *